US010792797B2

(12) United States Patent
Grazioli et al.

(10) Patent No.: US 10,792,797 B2
(45) Date of Patent: Oct. 6, 2020

(54) HAND-HELD POWER TOOL AND DEVICE COMPRISING THE HAND-HELD POWER TOOL

(71) Applicant: HILTI AKTIENGESELLSCHAFT, Schaan (LI)

(72) Inventors: Mario Grazioli, Chur (CH); Karsten Rix, Aalen (DE); Joerg Stamm, Buchs SG (CH)

(73) Assignee: HILTI AKTIENGESELLSCHAFT, Schaan (LI)

( * ) Notice: Subject to any disclaimer, the term of this patent is extended or adjusted under 35 U.S.C. 154(b) by 552 days.

(21) Appl. No.: 15/536,547

(22) PCT Filed: Dec. 15, 2015

(86) PCT No.: PCT/EP2015/079847
§ 371 (c)(1),
(2) Date: Jun. 15, 2017

(87) PCT Pub. No.: WO2016/102252
PCT Pub. Date: Jun. 30, 2016

(65) Prior Publication Data

US 2018/0009096 A1 Jan. 11, 2018

(30) Foreign Application Priority Data

Dec. 22, 2014 (EP) ..... 14199817

(51) Int. Cl.
*B25C 1/00* (2006.01)
*B25F 5/02* (2006.01)
(Continued)

(52) U.S. Cl.
CPC ..... *B25C 1/008* (2013.01); *B25C 1/00* (2013.01); *B25C 7/00* (2013.01); *B25F 5/02* (2013.01); *B25G 1/04* (2013.01); *B25H 1/0035* (2013.01)

(58) Field of Classification Search
CPC .... B25C 1/00; B25C 1/06; B25C 1/18; B25C 1/008; B25C 7/00; B25F 5/02; B25H 1/0035
(Continued)

(56) References Cited

U.S. PATENT DOCUMENTS 3,272,267 A * 9/1966 Langas ..... B25C 7/00 173/170
4,284,223 A * 8/1981 Salcido ..... B25C 7/00 227/132
(Continued)

FOREIGN PATENT DOCUMENTS

DE 10 2012 212786 A1 1/2014
EP 1 486 294 B1 4/2008
(Continued)

OTHER PUBLICATIONS

International Bureau, International Search Report in International Application No. PCT/EP2015/079847, dated Mar. 24, 2016.

*Primary Examiner* — Scott A Smith
(74) *Attorney, Agent, or Firm* — Leydig Voit & Mayer, Ltd.

(57) ABSTRACT

The invention relates to a hand-held tool, in particular a nail-setting device, comprising a handle for manual actuation of the hand-held tool, an interface for fastening the hand-held tool to a remote actuation device, a control apparatus for controlling the hand-held tool in a manual mode and in a remote actuation mode, and a querying apparatus for querying whether the hand-held tool is fastened to a remote actuation device, wherein the control
(Continued)

apparatus controls the hand-held tool in the manual mode if the querying apparatus detects that the hand-held tool is not fastened to a remote actuation device, and wherein the control apparatus controls the hand-held tool in the remote actuation mode if the querying apparatus detects that the hand-held tool is fastened to a remote actuation device.

8 Claims, 2 Drawing Sheets

(51) Int. Cl.
*B25G 1/04* (2006.01)
*B25C 7/00* (2006.01)
*B25H 1/00* (2006.01)

(58) Field of Classification Search
USPC ..... 227/8, 9, 10, 130, 147, 156; 173/170, 173/169, 29, 30, 31, 171; 16/114.1, 426
See application file for complete search history.

(56) References Cited

U.S. PATENT DOCUMENTS 4,479,599 A * 10/1984 Conrad ..... B25C 1/18 227/156
4,736,804 A * 4/1988 Geibel ..... B25H 1/0035 173/30
5,135,388 A * 8/1992 Pettit ..... F23Q 2/16 126/25 B
5,199,625 A * 4/1993 Dewey ..... B25C 1/001 227/113
5,787,536 A * 8/1998 Pate ..... B27B 17/0008 30/122
7,228,917 B2 * 6/2007 Davis ..... B25C 7/00 16/114.1
7,258,261 B1 * 8/2007 Reyes ..... B25C 7/00 173/170
7,565,991 B2 * 7/2009 Erhardt ..... B25C 1/06 227/10
7,617,885 B2 * 11/2009 Howland ..... B25F 5/00 173/1
7,914,005 B2 * 3/2011 Blessing ..... B25C 1/008 227/10
8,020,739 B2 * 9/2011 Blessing ..... B25C 1/008 227/156
8,162,074 B2 * 4/2012 Cook ..... B23B 45/001 16/114.1
8,881,963 B2 * 11/2014 Cortez ..... B25C 7/00 227/130
8,915,414 B2 * 12/2014 Popovich ..... B25C 1/008 227/10
9,174,337 B2 * 11/2015 Buchner ..... B25H 1/0035
9,466,198 B2 * 10/2016 Burch ..... G08B 21/0213
2003/0168491 A1 * 9/2003 Goodwin ..... B25C 7/00 227/147
2005/0000713 A1 1/2005 Pourtler et al.
2008/0099524 A1 5/2008 Blessing et al.

FOREIGN PATENT DOCUMENTS

EP 1 916 066 A1 4/2008
EP 2 801 450 A1 11/2014

* cited by examiner

HAND-HELD POWER TOOL AND DEVICE COMPRISING THE HAND-HELD POWER TOOL

CROSS-REFERENCE TO RELATED APPLICATIONS

This patent application is the U.S. National Stage of International Application No. PCT/EP2015/079847, filed Dec. 15, 2015, which claims the benefit of European Application No. 14199817.9, filed Dec. 22, 2014, which are each incorporated by reference.

BACKGROUND OF THE INVENTION

The present invention relates to a hand-held power tool and a device including the hand-held power tool. Such devices are used, for example, for an overhead installation using hand-guided setting tools at high ceilings, where working otherwise would only be possible with the aid of working platforms or ladders. The setting tools usable with the device are conventionally operated using solid, gaseous or liquid fuel or also using pressurized or compressed air or are electrically operated.

Known are hand-held power tools, in particular setting tools, which are configured for application against a ceiling. Such hand-held power tools, for example, are triggered directly by pressing against the ceiling. To prevent triggering by accidental bumping against an obstacle, an orientation-dependent safety yoke is known, which enables a triggering only if the hand-held power tool is oriented perpendicularly against the ceiling. The hand-held power tool is then, however, not suited for other applications, for example, against a wall or a floor.

An extension pole for actuating a hand-held power tool is known from EP 1 486 294 B1, at which a hand-held power tool may be fastened with the aid of claws spreading pull rods. Using an extension pole, the hand-held power tool behaves during an operation exactly in the same manner as during a manual operation without an extension pole.

BRIEF SUMMARY OF THE INVENTION

The object of the present invention is to provide a hand-held power tool in which the mentioned disadvantages are reduced or eliminated.

The object is achieved by a hand-held power tool including a handle for manually actuating the hand-held power tool, an interface for fastening the hand-held power tool to a remote actuation device, a control device for controlling the hand-held power tool in a manual mode and in a remote actuation mode, an interrogator for interrogating whether the hand-held power tool is fastened to a remote actuation device, the control device controlling the hand-held power tool in the manual mode if the interrogator detects that the hand-held power tool is not fastened to a remote actuation device, and the control device controlling the hand-held power tool in the remote actuation mode if the interrogator detects that the hand-held power tool is fastened to a remote actuation device. In so doing, the hand-held power tool is configurable for manual operation as well as also for remote operation, for example at a ceiling. Preferably, the hand-held power tool includes a nail setting tool.

According to an advantageous embodiment, the interrogator includes a sensor, preferably a magnetic sensor, a RFID reader, a preferably mechanically, electromechanically, optically inductively or capacitively actuatable switch or an electrical, preferably wire-connected or also preferably wireless, or optical device interface.

According to an advantageous embodiment, the hand-held power tool furthermore includes a position detection device for detecting how the hand-held power tool is oriented in the space, a triggering of the hand-held power tool in the remote actuation mode being enabled only if the position detection device detects that the hand-held power tool is oriented substantially vertically upward in the working direction and, in the manual mode, a triggering of the hand-held power tool is enabled independently from the orientation of the hand-held power tool in the space.

According to an advantageous embodiment, the hand-held power tool furthermore includes a pressing sensor for detecting whether the hand-held power tool is pressed against a substrate, a triggering of the hand-held power tool enabled in the manual mode only if the hand-held power tool is pressed against the substrate and, in the remote actuation mode, a triggering of the hand-held power tool occurring by pressing the hand-held power tool against the substrate.

According to an advantageous embodiment, the hand-held power tool is part of a device including a remote actuation device having a detection unit which enables the detection by the interrogator.

According to an advantageous embodiment, the detection unit includes a magnetic element, an RFID element, an actuation element actuating the switch if the hand-held power tool is fastened to the remote actuation device or an electrical, preferably wire-connected or also preferably wireless, or optical counter-interface.

According to an advantageous embodiment, the remote actuation device has a handle element, preferably a pole, having a remote trigger for actuation by a user and a transmission device for transmitting an actuation of the remote trigger to an activation switch of the hand-held power tool. Preferably, the remote actuation device includes an input unit and/or includes a display unit for the control device of the hand-held power tool.

The drawings illustrate the present invention in one exemplary embodiment.

BRIEF DESCRIPTION OF THE SEVERAL VIEWS OF THE DRAWING(S)

DETAILED DESCRIPTION OF THE INVENTION

Figure 1:
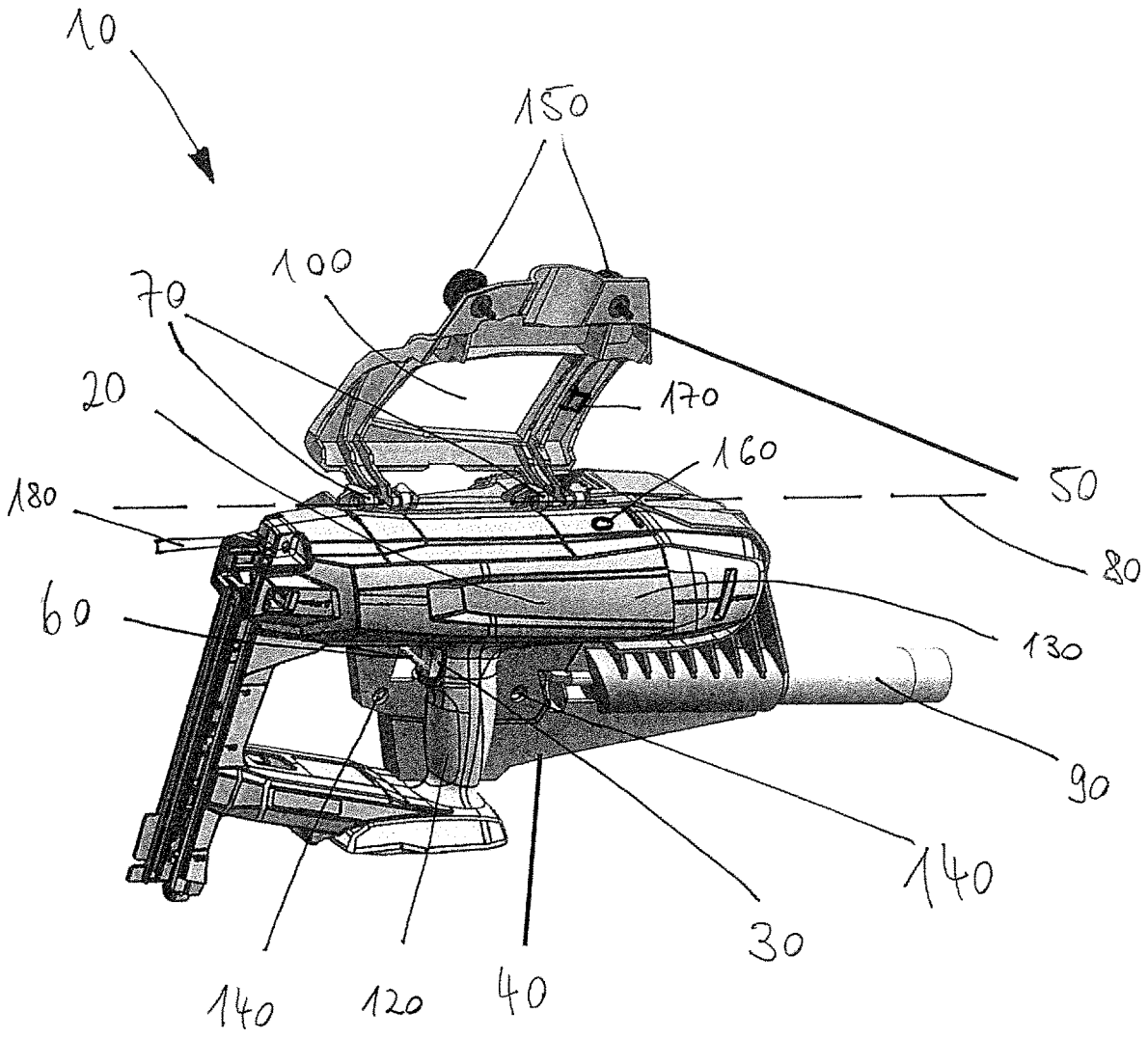
FIG. 1 shows an open device for remote actuation, having an inserted hand-held power tool.
Figure 2:
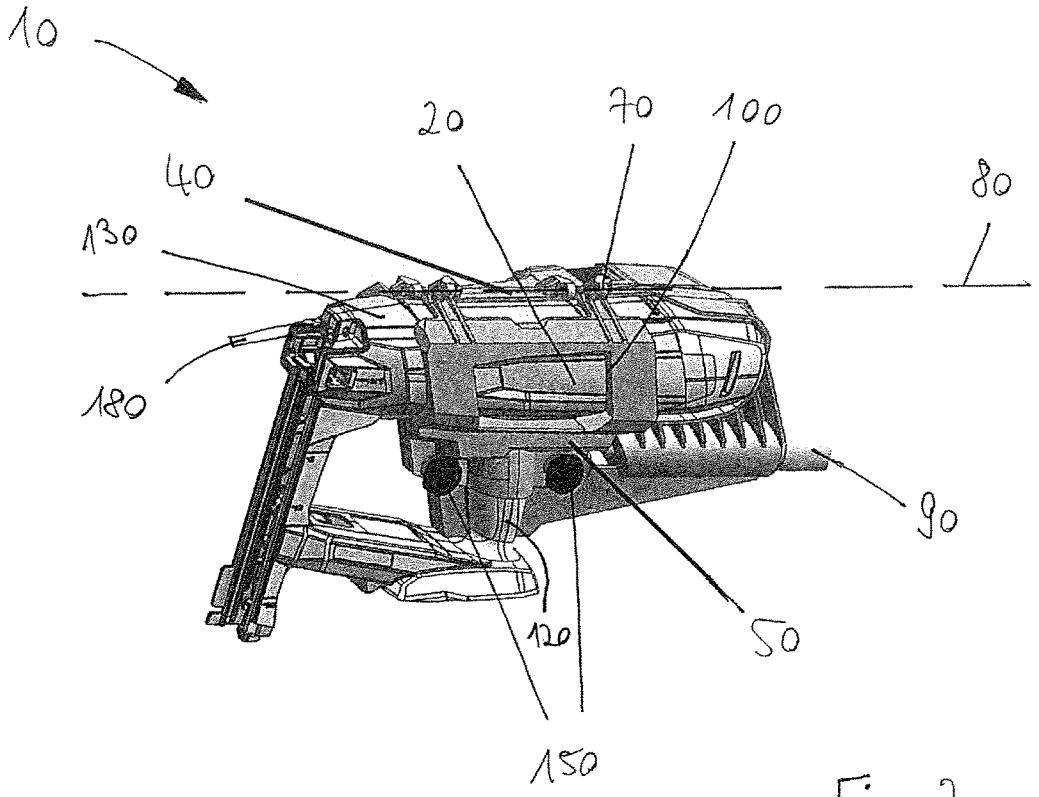
FIG. 2 shows in an oblique view a closed device for remote actuation, having a hand-held power tool accommodated therein.
Figure 3:
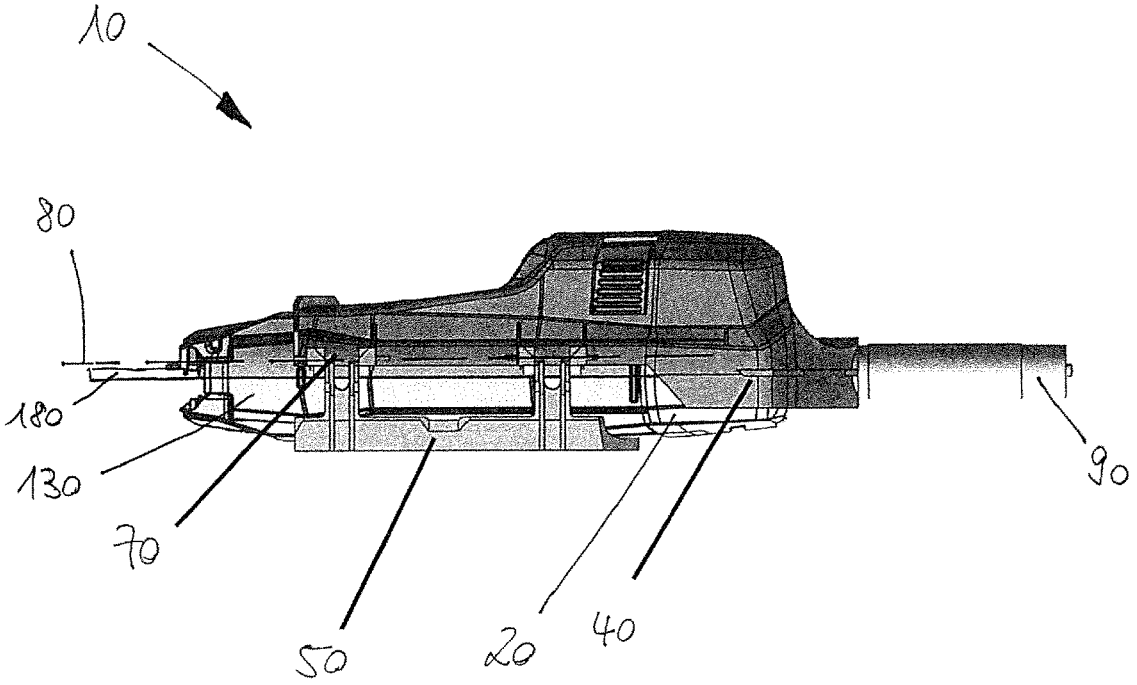
FIG. 3 shows in a top view a closed device for remote actuation, having a hand-held power tool accommodated therein.

FIGS. 1 through 3 show a device 10 for the remote actuation of a hand-held power tool 20 having a trigger switch 30. Device 10 has a first half shell 40 and a second half shell 50 having a viewing window 100 which preferably is made at least partially out of plastic. Furthermore, device 10 has an actuation device for actuating trigger switch 30, of which an actuation element 60 positioned directly opposite of trigger switch 30 is shown. First half shell 40 and second half shell 50 are permanently connected to each other via two hinges 70 defining a pivot axis 80.

Furthermore, device 10 has a releasable closure, which, when device 10 is closed, is situated on a side of hand-held power tool 20 opposite of pivot axis 80. The closure is formed by a screw connection, which includes two screws 150 at second half shell 50 and two respective threaded holes 140 at first half shell 40.

Furthermore, device 10 has a pole shaped handle element 90 having a remote trigger (not shown) for actuation by a user and a transmission unit for transmitting an actuation of the remote trigger to the actuation device to actuate trigger switch 30 by way of actuation element 60.

Hand-held power tool 20 includes a handle 120 for the manual actuation of hand-held power tool 20 and a housing 130 forming an interface for fastening hand-held power tool 20 at device 10. Hand-held power tool 20 furthermore includes a pressing sensor 180 for detecting whether hand-held power tool 20 is pressed against a substrate. In housing 130, a control device not shown in greater detail for controlling hand-held power tool 20 as well as a position detection device are disposed for detecting how hand-held power tool 20 is oriented in the space. An interrogator configured as a switch 160 for interrogating whether hand-held power tool 20 is fastened to device 10, is situated at the interface. For actuating the interrogator, device 10 has a detection device configured as actuation element 170. Furthermore, a mechanical energy store not shown in greater detail, for example a helical spring or a flywheel, is disposed in housing 130.

As long as switch 160 is not pressed, the control device controls hand-held power tool 20 in a manual mode, in which a triggering of hand-held tool 20 is possible only if pressing sensor 180 detects that hand-held power tool 20 is pressed against the substrate. Thus, hand-held power tool 20 is triggered only if trigger switch 30 is pressed after hand-held power tool 20 has been pressed against the substrate. In contrast, a pressing of hand-held power tool 20 against the substrate when trigger switch 30 is pressed does not trigger hand-held tool 20. The mechanical energy store is respectively charged as soon as possible after a positioning, for example, if the pressing sensor detects that hand-held power tool 20 is no longer pressed against the substrate.

As long as switch 160 is pressed, the control device controls hand-held power tool 20 in a remote actuation mode, in which a triggering of hand-held power tool 20 already occurs when hand-held power tool 20 is pressed against the substrate. This triggering however is enabled only if the position detection device detects that hand-held power tool 20 is oriented substantially vertically upward, thus, when for example a nail is inserted into a ceiling. In this case, pressing sensor 180 projects vertically upward from hand-held power tool 20. Furthermore, the mechanical energy store is charged in the remote actuation mode only when the hand-held power tool is moved from a horizontal position to the vertical position. For exemplary embodiments which are not shown, the remote actuation device has its own control device, which communicates via an electrical, preferably wireless, or optical interface of the hand-held power tool and a respective counter-interface of the remote actuation device, and, for example, has its own power supply or is supplied with power from the hand-held power tool. A position detection device or a pressing sensor in the form of a proximity or distance measurement sensor is also disposed at or in the remote actuation device. Then, the remote trigger is, for example, configured as an electrical trigger switch and the information which has been triggered is transmitted via the interface and the counter-interface to the hand-held power tool, whereupon the hand-held power tool is triggered.

The present invention has been illustrated on the basis of the example of a nail setting tool. It should however be noted that the present invention may also be used otherwise.

The invention claimed is:

1. A hand-held device comprising a power nail-setting tool operable in a manual mode and in a remote actuation mode;

the hand-held device further comprising a handle for manually actuating the power nail-setting tool;

an interface for providing communication between the power nail-setting tool and a remote actuation device;

an interrogator for interrogating whether the power nail-setting tool is actuated by the remote actuation device through the interface, wherein the power nail-setting tool is operable in the manual mode if the interrogator detects that the power nail-setting tool is not actuated by the remote actuation device, and wherein the power nail-setting tool is operable in the remote actuation mode if the interrogator detects that the power nail-setting tool is actuated by the remote actuation device through the interface.

2. The hand-held device as recited in claim 1, wherein the interrogator comprises a switch.

3. The hand-held device as recited in claim 2, wherein the switch is actuatable.

4. The hand-held device of claim 3, wherein the switch is actuatable by any one of the following: mechanically, electromechanical, optically, inductively, and capacitively.

5. The hand-held device as recited in claim 1, further comprising a pressing sensor for detecting whether the power nail-setting tool is pressed against a substrate, wherein in the manual mode triggering of the power nail-setting tool is enabled only if the power nail-setting tool is pressed against the substrate, and wherein in the remote actuation mode triggering of the power nail-setting tool occurs if the power nail-setting tool is pressed against the substrate.

6. The hand-held device as recited in claim 1, wherein the detection device comprises an actuation element, wherein the actuation element actuates the switch when the hand-held device is actuated by the remote actuation device.

7. The hand-held device as recited in claim 1 wherein the remote actuation device has a handle element.

8. The hand-held device of claim 7, wherein the handle element comprises a pole.

* * * * *